US008387756B2

(12) United States Patent
Laihanen et al.

(10) Patent No.: US 8,387,756 B2
(45) Date of Patent: Mar. 5, 2013

(54) METHOD AND SYSTEM FOR ALLOCATION OF DESTINATION CALLS IN ELEVATOR SYSTEM

(75) Inventors: Pentti Laihanen, Hyvinkää (FI); Jukka Turpeinen, Rajamäki (FI); Johannes de Jong, Järvenpää (FI)

(73) Assignee: Kone Corporation, Helsinki (FI)

( * ) Notice: Subject to any disclaimer, the term of this patent is extended or adjusted under 35 U.S.C. 154(b) by 414 days.

(21) Appl. No.: 12/757,747

(22) Filed: Apr. 9, 2010

(65) Prior Publication Data

US 2010/0219025 A1 Sep. 2, 2010

Related U.S. Application Data

(63) Continuation of application No. PCT/FI2008/000101, filed on Sep. 12, 2008.

(30) Foreign Application Priority Data

Oct. 11, 2007 (FI) ..... 20070766

(51) Int. Cl.
*B66B 1/18* (2006.01)

(52) U.S. Cl. ..... 187/387; 187/391; 187/902

(58) Field of Classification Search ..... 187/247, 187/248, 380–388, 391–393, 902
See application file for complete search history.

(56) References Cited

U.S. PATENT DOCUMENTS

| | | | | |
|---|---|---|---|---|
| 4,836,336 | A | 6/1989 | Schroder | |
| 4,993,518 | A | 2/1991 | van Straaten et al. | |
| 6,237,721 | B1 * | 5/2001 | Siikonen | 187/382 |
| 6,871,727 | B2 * | 3/2005 | Jokela et al. | 187/383 |
| 6,945,365 | B2 * | 9/2005 | Matela | 187/382 |
| 7,198,136 | B2 * | 4/2007 | Urata | 187/383 |
| 7,841,450 | B2 * | 11/2010 | Smith et al. | 187/249 |
| 7,913,819 | B2 * | 3/2011 | Siikonen et al. | 187/382 |
| 8,100,230 | B2 * | 1/2012 | Smith et al. | 187/249 |
| 8,132,652 | B2 * | 3/2012 | Hakala et al. | 187/249 |
| 2002/0033306 | A1 | 3/2002 | Kostka et al. | |
| 2005/0077115 | A1 | 4/2005 | Urata | |
| 2006/0096811 | A1 | 5/2006 | Terry et al. | |
| 2008/0236956 | A1 | 10/2008 | Finschi | |
| 2012/0037461 | A1 * | 2/2012 | Finschi | 187/382 |

FOREIGN PATENT DOCUMENTS

| | | | |
|---|---|---|---|
| JP | 3-192078 | A | 8/1991 |
| JP | 11-130349 | A | 5/1999 |
| WO | WO 2007/014477 | A2 | 2/2007 |
| WO | WO 2007147927 | A1 * | 12/2007 |

* cited by examiner

*Primary Examiner* — Anthony Salata
(74) *Attorney, Agent, or Firm* — Birch, Stewart, Kolasch & Birch, LLP

(57) ABSTRACT

A solution for the allocation of destination calls in an elevator system includes one or more single-deck elevators and one or more multi-deck elevators, in which system the passenger enters a destination call via a destination call device. The destination call entered by the passenger is received, an elevator type to serve the destination call is selected on the basis of an elevator type selection criterion, and the destination call is allocated to an elevator consistent with the elevator type thus selected.

20 Claims, 2 Drawing Sheets

A-E: elevators
1-8: floors
1000: group control section
1001: communication bus
1002: elevator control unit
1003: control bus
1004: destination call device
1005: upper car
1006: lower car
1100: escalator A-E: elevators 1-8: floors 1000: group control section 1001: communication bus 1002: elevator control unit 1003: control bus 1004: destination call device 1005: upper car 1006: lower car 1100: escalator

METHOD AND SYSTEM FOR ALLOCATION OF DESTINATION CALLS IN ELEVATOR SYSTEM

This application is a Continuation of PCT International Application No. PCT/FI2008/000101 filed on Sep. 12, 2008, which claims the benefit to Patent Application No. 20070766 filed in Finland, on Oct. 11, 2007. The entire contents of all of the above applications is hereby incorporated by reference.

BACKGROUND OF THE INVENTION

1. Field of the Invention

The present invention relates to elevator systems. In particular, the invention relates to a method and system for allocating destination calls in an elevator system comprising both single-deck and multi-deck elevators.

2. Background of the Invention

Tall buildings typically contain numerous elevators, escalators and other corresponding conveying means for transporting people from one floor to another in the building. When a passenger inputs a call for an elevator, the group control function of the elevator system allocates an elevator to serve the passenger according to the situation prevailing in the elevator system and on the basis of given optimization criteria. In a conventional elevator system, call entry is arranged by providing each floor of the building with up/down buttons, by means of which the passenger indicates the desired traveling direction and, further, after the elevator has arrived at the floor where the passenger is located, the passenger indicates the desired destination floor by means of floor selection buttons provided in the elevator car. However, the above-described call entry method is impractical and inefficient in tall buildings, which is why call entry in the elevator systems in such buildings is increasingly implemented using a so-called destination call system, wherein each passenger gives his/her individual destination data already at the starting floor, e.g. in the elevator lobby before boarding an elevator car. A destination call is input via a specific destination call terminal using either buttons and/or electrically readable identifiers, such as e.g. RFID identifiers. As the starting and final points of the route to be traveled by each passenger are identified in connection with the destination call and are therefore available to the group control, the group control system is able to determine the passenger's route accurately and optimally as compared to the traditional call entry system.

Allocation of calls entered by passengers aims at estimating different route alternatives for the passengers and assigning the calls to be served by the elevators so as to optimize one of the indicators describing the elevator system or a combination of such indicators. Traditionally, the most commonly used indicators relate to passenger service times, but it is also possible to use optimization criteria relating to energy or some other corresponding property of the elevator system. To compare different route alternatives, a so-called cost function is generally used, minimization of whose value (total cost) for different route alternatives indicates optimal allocation. Allocation can also be so implemented that in different traffic situations the cost function best suited for the particular situation is applied. The purpose of this is to allow the system to adapt to the prevailing traffic situation, e.g. an up-peak traffic situation in the building. A relevant description of the technique in question is found e.g. in patent specification FI972937, which discloses an elevator group control method whereby the control of the elevators is optimized on the basis of the traffic situation, i.e. the prevailing traffic type and traffic intensity, by identifying the prevailing traffic situation and controlling the elevator group on the basis of optimization criteria corresponding to the aforesaid traffic situation. To identify the prevailing traffic situation, statistical data is collected on the operation of the elevator system according to different times of the day and different days of the week, and a forecast on the future state of the elevator system at each instant of time is produced on the basis of the statistical data collected. The solution in question is termed 'traffic forecaster'.

To improve the efficiency of elevator systems and to avoid congestion, especially in tall buildings, the elevators may be implemented as multi-deck elevators. In multi-deck elevators, two or more elevator cars are arranged in the same frame structure, which moves in the elevator shaft as driven by the drive machine, so that the elevator serves several floors simultaneously when it stops. To ensure efficient operation of multi-deck elevators, the entrance lobby of the building is often divided into two or more waiting lobbies, which are interconnected e.g. by escalators. In this case, the destination call devices can be disposed either in the waiting lobbies in the immediate vicinity of the elevators, or in a centralized manner in the entrance lobby, from where passengers are guided via escalators into the waiting lobby according to the allocated route and further to the elevator serving the passenger.

As mentioned above, multi-deck elevators are able to serve even large numbers of passengers effectively, e.g. during up-peak conditions as people are arriving at their jobs in the mornings and the main direction of traffic is from the entrance lobby to upper floors in the building. However, it has been established that, in certain traffic situations, e.g. at lunch time, where the direction of traffic flow is from the entrance lobby to the upper floors of the building or vice versa and at the same time inter-floor traffic occurs within the building, the transport capacity of multi-deck elevators may be reduced significantly when both peak traffic and inter-floor traffic have to be served by multi-deck elevators. The problem may be aggravated in destination control systems, where an elevator is immediately allocated to serve a passenger having entered a call (and the passenger is given corresponding information). In this case, the group control has no chance to subsequently change the elevator serving the call and is therefore unable to optimize the selected elevator routes, whereas such possibilities are available in elevator systems using the traditional up/down call entry method. Allocation performed immediately on the basis of a call may thus be unfavorable when new calls are to be allocated after a previously entered call, leading to underutilization of the capacity of the elevator system.

The use of multi-deck elevators also involves certain additional drawbacks. The multi-deck elevator is ill adapted for certain special applications, such as e.g. for use as a fire-fighting elevator, because in this application it may be required that, to provide the service capacity prescribed by elevator regulations, extra floor space be provided at the upper or lower end of the elevator shaft. Besides, multi-deck elevators are more complex in respect of both mechanical construction and control system as compared to single-deck elevators. The structural complexity of multi-deck elevators may also be increased as a result of variation in the floor heights of the building, because in such cases the multi-deck elevator has to be provided with a mechanism that allows the mutual distance between the elevator decks to be varied according to the floor height so as to permit simultaneous service to the floors in question. On the whole, the use of multi-deck elevators increases the acquisition and maintenance costs of elevator systems, and therefore multi-deck elevator systems are expensive. A possible approach to solve some of the above-described problems is to implement the elevator system using both single-deck elevators and multi-deck elevators in the same elevator system. Japanese application publication JP11130349, among others, discloses an elevator group comprising both single-deck elevators and double-deck elevators. This solution is based on a zoning arrangement in which the single-deck elevators and double-deck elevators serve different zones in peak traffic situations.

SUMMARY OF THE INVENTION

The object of the present invention is to overcome or at least alleviate the above-described drawbacks encountered in prior-art solutions. A further object of the invention is to accomplish one or more the following objectives:

- to improve the transport capacity of an elevator system in different traffic conditions and extraordinary situations,
- to reduce congestion in waiting lobbies,
- to simplify the elevator system,
- to improve traveling comfort by allocating different elevator types on different optimization criteria,
- to take passengers' special needs into account in call allocation.

Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. Within the framework of the basic inventive concept, features of different embodiments of the invention can be applied in conjunction with other embodiments.

Below, the meanings of certain terms used in the present application are defined:

- multi-deck elevator: This term refers to an elevator having two or more elevator cars mounted in a common frame structure, which is moved in an elevator shaft by an elevator drive machine. A multi-deck elevator serves two or more waiting lobbies simultaneously when stopping at floors. A multi-deck elevator having two elevator cars in the same frame structure is called double-deck elevator.
- traffic situation: Defines the traffic type and traffic intensity prevailing in the elevator system, e.g. "light mixed traffic". Traffic type indicates the direction of passenger flows generally prevailing in the elevator system, e.g. upward traffic (from the entrance lobby to other floors of the building), downward traffic (from other floors of the building to the entrance lobby), internal traffic (inter-floor traffic with no passengers entering or leaving the building), two-way traffic (simultaneous upward and downward traffic), mixed traffic (combination of different traffic types). Traffic intensity indicates the intensity of the traffic prevailing in the elevator system in relation to the maximum transport capacity of the elevator system, e.g. light traffic, normal traffic, heavy traffic. Besides those mentioned above, many other classifications of traffic type and traffic intensity are possible.
- elevator type: This term refers either to a single-deck elevator or a multi-deck elevator.
- destination-call traffic type: This term refers to the traffic type indicated by the starting floor and destination floor of a destination call, such as e.g. upward call (a call from the entrance lobby to other floors in the building), downward call (a call from other floors of the building to the entrance lobby), internal traffic call (a call between internal floors in the building), call to even floors (from an even floor to another even floor), call to odd floors (from an odd floor to another odd floor), and so on.
- odd/even principle: This term refers to a principle in the control of a double-deck elevator whereby one of the decks of the elevator is only used to serve even floors while the other deck is only used to serve odd floors. The division into odd and even floors depends on the floor numbering of the building and is therefore a factor determining whether the lower deck of a double-deck elevator is only used to serve even floors or odd floors and, similarly, whether the upper car is only used to serve odd floors or even floors.
- car adjustment delay: This term refers to the time required for adjusting the spacing between the decks of multi-deck elevators to a desired inter-car distance. In cases where the floor heights of the building vary, the spacing between the decks of multi-deck elevators has to be adjusted, and the amount of time (car adjustment delay) required for this purpose depends on the magnitude of the difference between the floor heights of the departure floors and destination floors along the route of the elevator.

The present invention discloses a method for allocating destination calls in an elevator system comprising one or more single-deck elevators and one or more multi-deck elevators, in which method the passenger enters a destination call via a destination call device. According to the invention, the method comprises the steps of: receiving the destination call entered by the passenger; selecting the elevator type to serve the destination call on the basis of a criterion for elevator type selection; allocating the destination call to an elevator consistent with the selected elevator type; and informing the passenger as to the elevator allocated for him/her.

The present invention also discloses a system for the allocation of destination calls in an elevator system which comprises one or more single-deck elevators and one or more multi-deck elevators and destination call devices for receiving destination calls entered by the passenger. According to the invention, the system comprises means arranged to determine, on the basis of an elevator type selection criterion, the elevator type to serve the destination call entered by the passenger, as well as means arranged to allocate the aforesaid destination call to an elevator consistent with the selected elevator type, and means for informing the passenger as to the elevator allocated for him/her.

In an embodiment of the invention, the elevator type selection criterion used consists of one or more classification rules, said classification rule determining the elevator type

- on the basis of predetermined regular floors;
- on the basis of the traffic type of the destination call received;
- on the basis of auxiliary data attached to the destination call received, wherein the auxiliary data indicates special transport and/or group size of the call;
- on the basis of floor-specific traffic intensities; or
- on the basis of the degree of loading of the elevators in the elevator system.

This embodiment allows the elevator type selection criterion to be optimized specifically for each building and elevator system so as to accomplish desired service objectives. In the elevator system, it is possible e.g. to determine regular floors that are always served by single-deck elevators or multi-deck elevators, internal traffic in the building can be served by single-deck elevators, and so on.

In an embodiment of the invention, the car adjustment delay of multi-deck elevators is taken into account in the selection of the elevator type to serve the call. In this embodiment, those multi-deck elevators in which the time for adjustment of the inter-car distance is too long for the adjustment operation to be carried out during the time it takes the elevator to travel to the starting floor of the call or from the starting floor to the destination floor of the call can be excluded from among the prospective elevators to serve the call. This embodiment makes it possible to improve the transport capacity of the elevator system and the traveling comfort it provides.

In an embodiment of the invention, the classification rules and/or the threshold values of the classification rules for the elevator type selection criterion are selected on the basis of the traffic situation and/or an exceptional situation prevailing in the elevator system. This embodiment makes it possible to dynamically change the selection criterion according to the traffic situation prevailing in the elevator system and thus to optimize the transport capacity and/or some other desired property of the elevator system so as to optimally match the prevailing traffic situation. This embodiment allows the behavior of the elevator system to be optimized even in exceptional situations, e.g. when one or more elevators in the elevator system is/are inoperative or when the building is being evacuated e.g. due to a fire detected in the building.

In another embodiment of the invention, different optimization criteria are used in the allocation of passengers' destination calls to different elevator types. In this embodiment, enhanced optimization of the overall operation of the elevator system and of the traveling comfort provided by it can be accomplished e.g. by emphasizing a short traveling time for multi-deck elevators and a short waiting time for single-deck elevators when single-deck elevators are used to serve internal traffic in the building.

In an embodiment of the invention, statistics are collected about passenger events in the elevator system, which statistical data is utilized in the determination of the traffic situation prevailing in the elevator system and/or in the determination of floor-specific traffic intensities in the elevator system. This embodiment makes it possible to produce more accurate estimates of the traffic situation prevailing in the elevator system at different times, and in general of the flow of traffic in the building.

In an embodiment of the invention, one or more single-deck elevators are used as fire-fighting elevators. This embodiment makes it unnecessary to provide in the elevator system extra headroom for a fire-fighting elevator at the upper or lower end of the elevator shaft as is required in the case of multi-deck elevators.

Besides the above-described advantages, the present invention also provides many other advantages as compared to prior-art solutions. By applying the invention, the elevator system can be simplified by implementing some of the elevators as single-deck elevators, while at the same time the transport capacity of the elevator system in different traffic situations can be improved. The invention makes it possible to advantageously avoid the utilization of the capacity of multi-deck elevators in congested conditions to serve low-intensity traffic even if such utilization might seem to be an efficient expedient on the basis of traditional allocation methods. In the solution of the invention, passengers' special needs, such as transportation of handicapped persons, can be better attended to by using the most appropriate elevator type to serve passengers needing special transportation. The invention further provides the possibility that, when the multi-deck elevators used in the elevator system are double-deck elevators, calls can be allocated on the so-called odd/even principle, thereby maximizing the transport capacity of the double-deck elevators. Furthermore, the multi-deck elevators need not necessarily be provided with any specific adjustment means for the adjustment of inter-car distances because, in the solution of the invention, floors spaced at irregular intervals can be advantageously served using single-deck elevators.

BRIEF DESCRIPTION OF THE DRAWINGS

In the following, the invention will be described in detail by referring to the attached drawings, wherein.

DETAILED DESCRIPTION OF THE PREFERRED EMBODIMENTS

Figure 1:
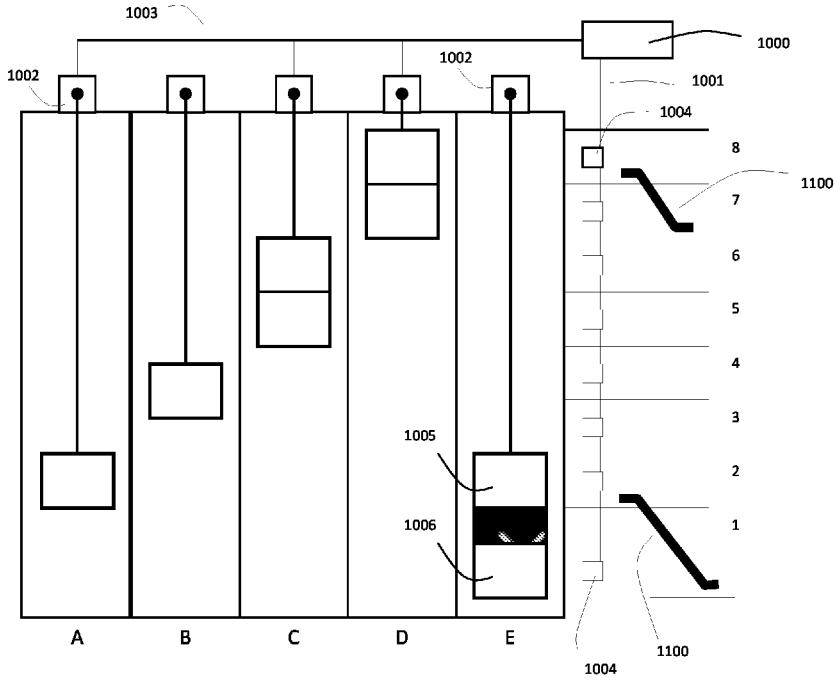
FIG. 1 presents an elevator system according to the invention by way of example.

FIG. 1 presents an elevator system in which the solution of the invention is applied. The elevator system comprises five elevators A . . . E. Of these, elevators A and B are single-deck elevators while elevators C, D and E are double-deck elevators. In the building, the elevators serve floors 1-8, floor 1 being the entrance/exit lobby of the building and floor 8 the upper lobby of the building. Provided between floors 1 and 2 and between floors 7 and 8 are escalators 1100, which the passenger can use for easy passage from one floor (waiting lobby) to another e.g. when calls are allocated to the double-deck elevators C, D, E, thus ensuring more effective utilization of especially the double-deck elevators. From FIG. 1 it can also be seen that floor 1 has a larger floor height that the other floors, and thus the upper car 1005 and lower car 1006 of the elevator E at floors 1 and 2 have been adjusted to an inter-car distance larger than the inter-car distance of the double-deck elevators C, D at the other floors. The number of different elevator types can be determined e.g. from estimated traffic flows in the building, in such manner that multi-deck elevators are employed as far as possible to serve rush-hour traffic and single-deck elevators to serve the quieter internal traffic in the building. A feasible thumb rule might be that about 10-30% of the calls should be served by single-deck elevators and the rest by multi-deck elevators, but many other design principles may also be employed to determine the numbers of elevator types.

As illustrated in FIG. 1, the elevator system comprises a group control section 1000, whose primary function is to receive destination call data entered by passengers via call panels (destination call devices) 1004, to allocate an elevator to each passenger and to send operation commands consistent with the call to the allocated elevator. For the transmission of operation commands and elevator status data between the group control section and the individual elevator control units, the group control section is connected to the individual elevator control unit 1002 of each elevator via a control bus 1003. On the other hand, the destination call devices 1004 provided at the landings 1-8 are connected to the group control section via a communication bus 1001 for elevator landing devices. The destination call devices may consist of any destination call devices appropriate for the purpose, e.g. call entry devices provided with push buttons and/or call entry devices whereby the passenger is identified by means of an electric identifier and the destination floor for that individual passenger is determined on the basis of this identification.

The number and disposition of the destination call devices on each floor can be freely chosen; for example, deviating from FIG. 1, extra destination call devices may be placed in the immediate vicinity of an escalator, so that a passenger arriving in the entrance lobby can indicate his/her destination floor immediately upon reaching the entrance lobby. The destination call devices also include an information means (not shown in FIG. 1), e.g. a display means, which is used to indicate to the passenger which elevator is going to serve him/her and possibly also the waiting lobby into which the passenger has to pass in order to reach the elevator serving him/her. Using the destination call device, the passenger can give auxiliary information associated with his/her destination call, such as e.g. information regarding transport for a handicapped person, or information giving the number of persons included in a traveling group, in other words, via the destination call device, a group of passengers traveling to the same destination floor can enter only one destination call with auxiliary data giving the number of passengers in the group.

The group control section 1000 additionally contains a so-called traffic forecaster, which produces statistics on passenger events taking place in the elevator system at different times of the day and on different days of the week. Information is obtained on passenger events on the basis of the destination calls entered by passengers, but it is also possible to produce statistics from data obtained from different motion detectors, e.g. by monitoring car load weight and/or door light cell signals. Utilizing statistical data and the destination calls entered, the traffic forecaster determines the traffic situation prevailing in the elevator system at different times. Based on statistical information, it is further possible to estimate floor-specific traffic intensities (incoming and/or outgoing traffic on each floor), and this information can be utilized in the selection of the elevator type to serve a call.

When the passenger enters his/her destination call using the destination call device provided in the waiting lobby, the call data relating to the call are transmitted to the group control section. The call data define the passenger's starting floor and the passenger's destination floor. In addition, the call data may comprise auxiliary data associated with the call and given by the passenger, said auxiliary data informing the group control section as to whether the passenger is e.g. a handicapped person or for how many passengers the call has been entered.

Upon receiving the call data transmitted by the destination call device, the group control section, based on a so-called elevator type selection criterion, determines the elevator type to serve the passenger. In this context, 'elevator type selection criterion' refers to rules (classification rules) on the basis of which the system decides whether the call entered by the passenger is to be assigned to single-deck elevators or multi-deck elevators. This arrangement thus means pre-selection of elevator type prior to actual allocation of the call to an elevator of the selected elevator type. The elevator type to serve the call is determined by the selection criterion on the basis of one or more classification rules. There are many possible classification rules, and they can be selected so as to best suit each elevator system, e.g. on the basis of assumed traffic flows in the building, intended use of the building or some other corresponding criterion. The classification rules may be independent of the state of the elevator system, or they may vary according to the state of the elevator system, for example when the traffic situation prevailing in the elevator system changes or when an exceptional situation is detected in the elevator system, in other words, the system can employ a dynamically changing elevator type selection criterion so as to best suit the prevailing traffic situation or exceptional situation. The classification rules can be prioritized so that, in conflict situations where different classification rules recommend different elevator types, the classification rule having the highest priority determines the elevator type indicated by the selection criterion.

Described below are a few examples of classification rules that can be used as a basis of selection of the elevator type:

- Selection of elevator type is made on the basis of predetermined standard floors. One or more floors in the elevator system are determined which are always to be served by a given elevator type. For example, if the inter-floor distance between a given pair of floors is too large for the floors to be served simultaneously by a double-deck elevator in the elevator system, then these floors can be defined as floors to be always served by single-deck elevators. Thus, if the starting floor or destination floor of a destination call entered by a passenger is one of the floors in such a pair of floors, then a single-deck elevator is allocated to the passenger. Likewise, the most congested floors, such as the entrance lobby and sky lobby, can be defined as standard floors, so that all calls from the entrance lobby to the sky lobby or vice versa are always served by multi-deck elevators.
- Selection of elevator type is made on the basis of the traffic type of the call. Based on the starting floor and destination floor of the destination call entered by the passenger, the traffic type of the call (up call, down call, internal call, call to even or odd floor) is determined, and the elevator type to serve the call is selected accordingly. For example, up calls and down calls can be assigned to multi-deck elevators while calls for internal elevator trips within the building are assigned to single-deck elevators. It may be further considered whether the call can be served on the odd/even principle (call from odd floor to odd floor or from even floor to even floor), and if it can not, then the call will be served by a single-deck elevator.
- Selection of elevator type is made on the basis of the load factor of the elevators. The load factor (% of maximum capacity) of the elevators of each elevator type is determined separately for each elevator type, and if the load factor of the elevators of a given elevator type exceeds a certain threshold value, then the call is assigned to the elevator type having the lowest load factor.
- Selection of elevator type is made on the basis of floor-specific traffic intensities. The floors or floor zones having a traffic intensity exceeding a given threshold value are determined, and the floors/floor zones exceeding the threshold value are served by a desired elevator type. The traffic intensities can be considered on the basis of either the traffic departing from the floor/floor zone and/or the traffic arriving at it. For example, floor pairs where the sum of departing and arriving traffic intensities exceeds the given threshold value can be served by multi-deck elevators.
- Selection of elevator type is made on the basis of auxiliary data attached to the call. If there is auxiliary data attached to the call entered by the passenger, indicating e.g. transport for a handicapped person, goods transport or some other corresponding special transport, then the call can be assigned to a given elevator type; for example, persons with a physical disability can always be served by single-deck elevators instead of crowded multi-deck elevators. Similarly, if the group size indicated in connection with the call exceeds a given threshold value, then the call can be assigned to a certain elevator type, e.g. multi-deck elevators.

In the selection of elevator type, the car adjustment delay of multi-deck elevators is taken into account. For each multi-deck elevator, a length of time dependent on the different floor heights is determined which is needed for the adjustment of the inter-car distance when the floors indicated by the call are being served. Those multi-deck elevators for which the said length of time (car adjustment delay) exceeds the traveling time required for serving the call (traveling time to the departure floor indicated by the call or traveling time from the departure floor indicated by the call to the destination floor indicated by the call) are excluded from among the selectable elevators.

After the selection of the elevator type to serve the call, the group control section allocates an elevator to the passenger, using allocation methods known in themselves, e.g. genetic allocation methods, and restricting the allocation procedure to the selected elevator type only. The optimization criterion of allocation may be e.g. travel time, waiting time, energy, car fill factor, or a combination of these. The optimization criterion may also vary according to the traffic situation prevailing in the elevator system, and it may be different for different elevator types. For example, in heavy traffic conditions it is advantageous to optimize travel time instead of waiting time in order to maximize transport capacity. Once an elevator has been allocated to the passenger, the elevator serving the passenger and possibly also the waiting lobby where the passenger has to move to reach the allocated elevator are indicated via the information means of the destination call device.

Figure 2:
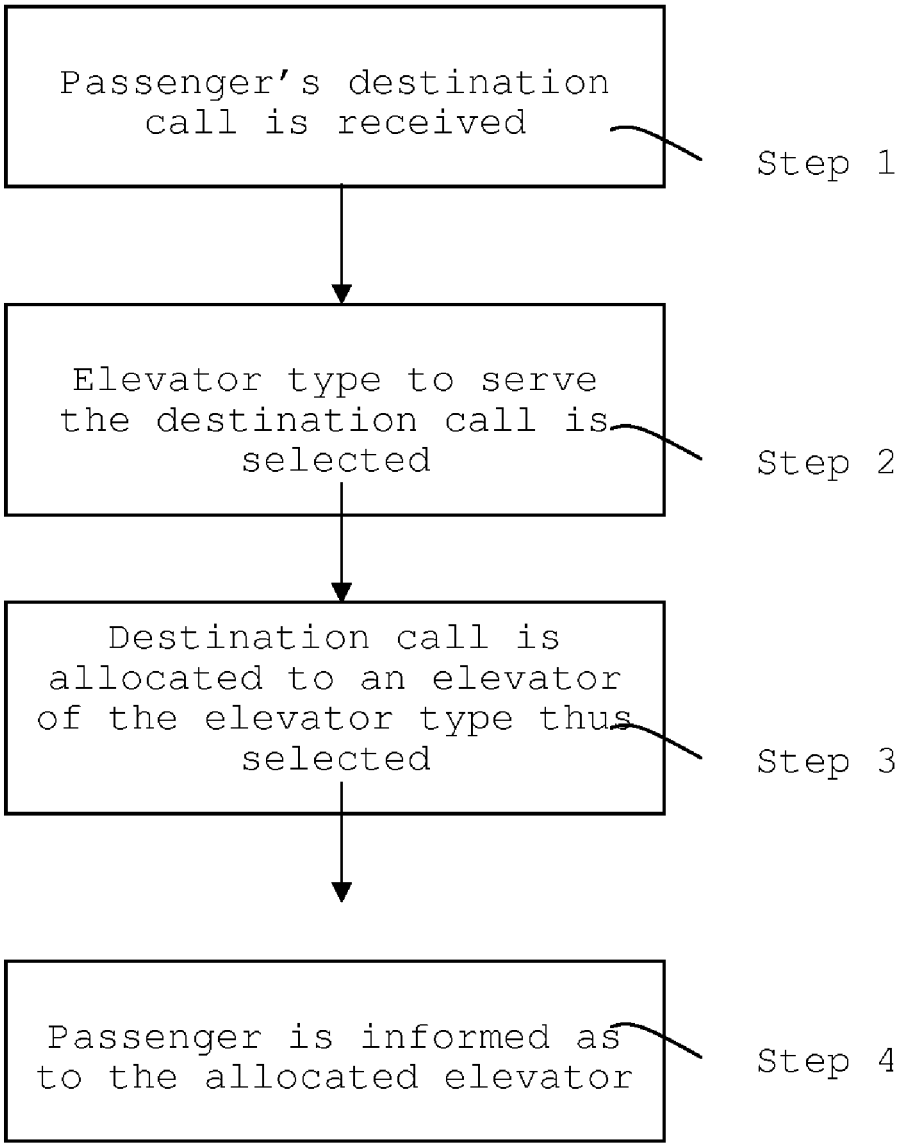
FIG. 2 presents the various steps comprised in the method of the invention.

FIG. 2 presents the different steps comprised in the method of the invention. In step 1, the passenger's destination call (destination call data) is received. In step 2, the elevator type to serve the destination call is selected on the basis of an elevator type selection criterion. In step 3, an elevator of the selected elevator type is allocated to the passenger. In step 4, the passenger is informed as to the elevator serving him/her, possibly indicating the waiting lobby as well.

The invention is not limited to the solution illustrated in FIG. 1, but it can also be implemented within the scope of the claims by forming two separate elevator groups, one consisting of single-deck elevators and the other of multi-deck elevators, each group having its own group control system. In this case, the group control systems are connected to a separate data system, which implements one or more sub-steps of the method of the invention.

The invention claimed is:

1. A method for the allocation of destination calls in an elevator system, said elevator system comprising one or more single-deck elevators and one or more multi-deck elevators, in the method the passenger enters a destination call via a destination call device, wherein the method comprises the steps of:

receiving the destination call entered by the passenger;

selecting on the basis of an elevator type selection criterion the elevator type to serve the destination call prior to actually allocating any elevator;

allocating the destination call to an elevator consistent with the elevator type thus selected; and informing the passenger as to the elevator allocated to the passenger.

2. The method according to claim 1, wherein the elevator type selection criterion used consists of one or more classification rules, said classification rules determining the elevator type on the basis of predetermined standard floors; or on the basis of the traffic type of the destination call received; or on the basis of auxiliary data attached to the destination call received, wherein the auxiliary data indicates special transport and/or group size of the call; or on the basis of floor-specific traffic intensities; or on the basis of the degree of load of the elevators in the elevator system.

3. The method according to claim 1, wherein, in the selection of elevator type, the car adjustment delay of multi-deck elevators is taken into account.

4. The method according to claim 3, wherein the multi-deck elevators for which the car adjustment delay is longer than the traveling time associated with the destination call are excluded from among the allocable elevators.

5. The method according to claim 1, wherein classification rules and/or threshold values of the classification rules for the elevator type selection criterion are selected on the basis of the traffic situation and/or an exceptional situation prevailing in the elevator system.

6. The method according to claim 1, wherein the method further comprises the steps of:

collecting statistical data about passenger events in the elevator system, utilizing the collected statistical data in determining the traffic situation and/or floor-specific traffic intensities in the elevator system.

7. The method according to claim 1, wherein, when the destination call received is of call type 'internal traffic within the building', the elevator type to be selected is single-deck elevator.

8. A method for the allocation of destination calls in an elevator system, said elevator system comprising one or more single-deck elevators and one or more multi-deck elevators, in the method the passenger enters a destination call via a destination call device, wherein the method comprises the steps of:

receiving the destination call entered by the passenger;

selecting on the basis of an elevator type selection criterion the elevator type to serve the destination call;

allocating the destination call to an elevator consistent with the elevator type thus selected; and informing the passenger as to the elevator allocated to the passenger, wherein one or more standard floors are determined such that destination calls issued from these floors are always served by single-deck elevators.

9. A method for the allocation of destination calls in an elevator system, said elevator system comprising one or more single-deck elevators and one or more multi-deck elevators, in the method the passenger enters a destination call via a destination call device, wherein the method comprises the steps of:

receiving the destination call entered by the passenger;

selecting on the basis of an elevator type selection criterion the elevator type to serve the destination call;

allocating the destination call to an elevator consistent with the elevator type thus selected; and informing the passenger as to the elevator allocated to the passenger, wherein one or more standard floors are determined such that destination calls issued from these floors are always served by multi-deck elevators.

10. The method according to claim 1, wherein different optimization criteria are used in the allocation of calls to different elevator types.

11. A method for the allocation of destination calls in an elevator system, said elevator system comprising one or more single-deck elevators and one or more multi-deck elevators, in the method the passenger enters a destination call via a destination call device, wherein the method comprises the steps of:

receiving the destination call entered by the passenger;

selecting on the basis of an elevator type selection criterion the elevator type to serve the destination call;

allocating the destination call to an elevator consistent with the elevator type thus selected; and informing the passenger as to the elevator allocated to the passenger, wherein a single-deck elevator is used as a firefighters' elevator.

12. A system for the allocation of destination calls in an elevator system comprising at least one single-deck elevator and at least one multi-deck elevator as well as call entry devices for receiving the destination call entered by the passenger, wherein the system further comprises:

a control device configured to determine an elevator type to serve the received destination call, based on an elevator type selection criterion, prior to actually allocating any elevator, and allocate the received destination call to an elevator of the elevator type thus selected; and an information device connected to the control device and configured to inform the passenger as to the elevator allocated for the passenger.

13. The system according to claim 12, wherein the control device is further configured to use one or more classification rules as the elevator type selection criterion, said classification rule defining the elevator type:

on the basis of predetermined standard floors; or on the basis of the traffic type of the destination call received; or on the basis of auxiliary data attached to the destination call received, wherein the auxiliary data indicates special transport and/or group size of the call; or on the basis of floor-specific traffic intensities; or on the basis of the degree of load of the elevators in the elevator system; or by taking into account the car adjustment delay of multi-deck elevators.

14. The system according to claim 12, wherein control device is further configured to collect statistical data about passenger events in the elevator system and determining, by utilizing the aforesaid statistical data, the traffic situation and/or floor-specific traffic intensities prevailing in the elevator system.

15. The method according to claim 2, wherein, in the selection of elevator type, the car adjustment delay of multi-deck elevators is taken into account.

16. The method according to claim 2, wherein the classification rules and/or the threshold values of the classification rules for the elevator type selection criterion are selected on the basis of the traffic situation and/or an exceptional situation prevailing in the elevator system.

17. The method according to claim 3, wherein the classification rules and/or the threshold values of the classification rules for the elevator type selection criterion are selected on the basis of the traffic situation and/or an exceptional situation prevailing in the elevator system.

18. The method according to claim 4, wherein the classification rules and/or the threshold values of the classification rules for the elevator type selection criterion are selected on the basis of the traffic situation and/or an exceptional situation prevailing in the elevator system.

19. The method according to claim 2, wherein the method further comprises the steps of:

collecting statistical data about passenger events in the elevator system, utilizing the collected statistical data in determining the traffic situation and/or floor-specific traffic intensities in the elevator system.

20. The method according to claim 3, wherein the method further comprises the steps of:

collecting statistical data about passenger events in the elevator system, utilizing the collected statistical data in determining the traffic situation and/or floor-specific traffic intensities in the elevator system.

* * * * *